US009523307B2

(12) United States Patent
Lee

(10) Patent No.: US 9,523,307 B2
(45) Date of Patent: Dec. 20, 2016

(54) ENGINE SYSTEM HAVING COOLANT CONTROL VALVE

(71) Applicant: Hyundai Motor Company, Seoul (KR)

(72) Inventor: Hyojo Lee, Suwon-si (KR)

(73) Assignee: Hyundai Motor Company, Seoul (KR)

( * ) Notice: Subject to any disclaimer, the term of this patent is extended or adjusted under 35 U.S.C. 154(b) by 219 days.

(21) Appl. No.: 14/548,618

(22) Filed: Nov. 20, 2014

(65) Prior Publication Data

US 2016/0084143 A1 Mar. 24, 2016

(30) Foreign Application Priority Data

Sep. 22, 2014 (KR) ..... 10-2014-0126196

(51) Int. Cl.

| | |
|---|---|
| ***F01P 7/14*** | (2006.01) |
| ***F01P 3/02*** | (2006.01) |
| ***F01P 3/12*** | (2006.01) |
| ***F01P 11/08*** | (2006.01) |
| ***F01P 7/16*** | (2006.01) |

(52) U.S. Cl.

CPC .. *F01P 7/14* (2013.01); *F01P 3/02* (2013.01); *F01P 3/12* (2013.01); *F01P 7/165* (2013.01); *F01P 7/167* (2013.01); *F01P 11/08* (2013.01)

(58) Field of Classification Search

CPC ..... F01P 7/14; F01P 3/02; F01P 3/12; F01P 7/165; F01P 7/167; F01P 11/08

See application file for complete search history.

(56) References Cited

U.S. PATENT DOCUMENTS 5,617,815 A * 4/1997 Spies ..... F16K 11/0853 123/41.1
6,164,248 A * 12/2000 Lehmann ..... F01P 5/10 123/41.1
6,371,060 B1 * 4/2002 Lehmann ..... F01P 7/167 123/41.1

FOREIGN PATENT DOCUMENTS

| | | | |
|---|---|---|---|
| JP | 2002-97958 | A | 4/2002 |
| KR | 10-2005-0061626 | A | 6/2005 |
| KR | 10-2013-0019172 | A | 2/2013 |

* cited by examiner

*Primary Examiner* — Lindsay Low
*Assistant Examiner* — Kevin Lathers
(74) *Attorney, Agent, or Firm* — Morgan, Lewis & Bockius LLP

(57) ABSTRACT

An engine system may include a first cylindrical valve in which a first outlet is formed from an interior surface to an exterior surface thereof and a second cylindrical valve inserted into the first cylindrical valve, an exterior circumference thereof sliding on the interior circumference of the first cylindrical valve, wherein a second outlet is formed to the second cylindrical valve corresponding to the first outlet, and the second cylindrical valve is separately rotatable in the first cylindrical valve, a drive portion that is engaged to the first cylindrical valve and the second cylindrical valve and disposed to respectively rotate the first cylindrical valve and the second cylindrical valve, and a control portion that controls the drive portion depending on a driving condition such that an overlapped area of the first outlet and the second outlet is controlled and coolant flowing the overlapped area is controlled.

8 Claims, 6 Drawing Sheets

ENGINE SYSTEM HAVING COOLANT CONTROL VALVE

CROSS-REFERENCE TO RELATED APPLICATION

The present application claims priority to and the benefit of Korean Patent Application No. 10-2014-0126196 filed on Sep. 22, 2014, the entire contents of which is incorporated herein for all purposes by this reference.

BACKGROUND OF THE INVENTION

Field of the Invention

The present invention is an engine system having a coolant control valve that respectively controls coolant passing an engine, a radiator, a heater core, and oil cooler so as to improve cooling efficiency and reduce fuel consumption.

Description of Related Art

The engine generates a torque by burning fuel, and exhausts the remainder in thermal energy. Particularly, cooling water absorbs heat while circulating the engine, a heater and a radiator and dissipates the heat to an outside of the engine.

If a cooling water temperature of the engine is low to elevate oil viscosity, it is a trend that friction force and fuel consumption increase and a temperature of exhaust gas rises slowly resulting to prolong a time period of catalyst activation to make a quality of the exhaust gas poor. Along with this, there is a trend that a time period for bringing a heater function to a normal level takes a long time to make occupants and a driver to feel cold.

If the cooling water temperature of the engine is excessive, knocking takes place, and, if ignition timing is adjusted for suppressing the knocking, performance is liable to become poor. And, if a lubrication oil temperature is excessive, a lubrication action is liable to become poor.

Accordingly, a temperature of a specific section of an engine is maintained to be high and that of other section of the engine is maintained to be low, wherein one integrated flow rate valve is used to control several cooling elements.

Further, in case that the coolant temperature is low, the viscosity of lubricant becomes high such that fuel consumption is increased, combustion efficiency is deteriorated, and harmful material of exhaust gas is increased. Also, in case that the coolant temperature is low, there is a problem that efficiency of a heater for heating interior room of a vehicle is deteriorated.

The information disclosed in this Background of the Invention section is only for enhancement of understanding of the general background of the invention and should not be taken as an acknowledgement or any form of suggestion that this information forms the prior art already known to a person skilled in the art.

BRIEF SUMMARY

Various aspects of the present invention are directed to providing an engine system having a coolant control valve having advantages of improving overall cooling efficiency and reducing fuel consumption by accurately controlling coolant flowing.

In an aspect of the present invention, an engine system having a coolant control valve, may include a first cylindrical valve in which a first outlet is formed from an interior surface to an exterior surface thereof, wherein the first cylindrical valve is rotatably disposed along a length direction central axis, a second cylindrical valve that is inserted into the first cylindrical valve, an exterior circumference thereof sliding on the interior circumference of the first cylindrical valve, wherein a second outlet is formed to the second cylindrical valve corresponding to the first outlet of the first cylindrical valve, and the second cylindrical valve is separately rotatable in the first cylindrical valve, a drive portion that is engaged to the first cylindrical valve and the second cylindrical valve and disposed to respectively rotate the first cylindrical valve and the second cylindrical valve, and a control portion that controls the drive portion depending on a driving condition such that an overlapped area of the first outlet and the second outlet is controlled and coolant flowing the overlapped area is controlled.

The drive portion may include a motor, a first drive gear that is connected to the motor, a first driven gear that is engaged to the first drive gear to rotate the first cylindrical valve, a second drive gear that is connected to the motor, and a second driven gear that is engaged to the second drive gear to rotate the second cylindrical valve.

The first drive gear and the second drive gear are direct connected to the motor.

The first drive gear is directly connected to the motor and the second drive gear is connected to the second drive gear through a gear box that may have a gear ratio or transforms a rotating direction.

The motor may include a first motor corresponding to the first drive gear, and a second motor corresponding to the second drive gear.

The first driven gear is formed on an exterior circumference of one end of the first cylindrical valve, and the second driven gear is formed on an exterior circumference of another end of the second cylindrical valve.

The first outlet may have a first output, a second output, a third output, and a fourth output, and the second outlet may have a fifth output, a sixth output, a seventh output, and an eighth output, and the first and fifth outputs supply a radiator with coolant, the second and sixth outputs supply an EGR cooler with coolant, the third and seventh outputs supply a heater core with coolant, and the fourth and eighth outputs supply an oil cooler with coolant.

Coolant is supplied to a central hollow portion of the first cylindrical valve and the second cylindrical valve, and the coolant is supplied from a cylinder head of an engine.

In accordance with the present invention for realizing the objects, a first cylindrical valve is inserted into a second cylindrical valve and rotation positions of outlets that are formed on the cylindrical valve are respectively controlled such that coolant flowing is accurately and quickly controlled and sealing performance is improved.

Accordingly, cooling efficiency is improved and simultaneously output of an engine is improved.

The methods and apparatuses of the present invention have other features and advantages which will be apparent from or are set forth in more detail in the accompanying drawings, which are incorporated herein, and the following Detailed Description, which together serve to explain certain principles of the present invention.

Figure 1:
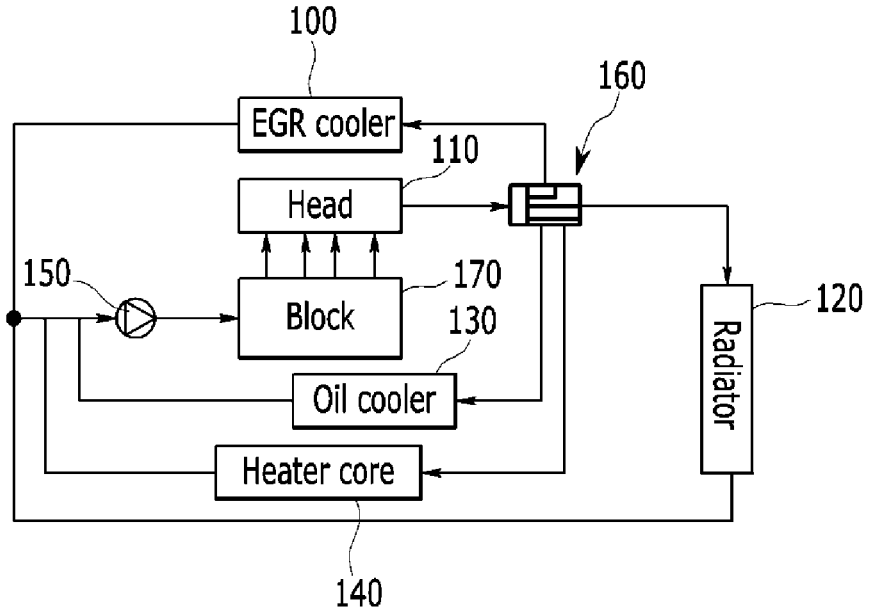
FIG. 1 is a schematic diagram of an engine system having a coolant control valve related to the present invention.

It should be understood that the appended drawings are not necessarily to scale, presenting a somewhat simplified representation of various features illustrative of the basic principles of the invention. The specific design features of the present invention as disclosed herein, including, for example, specific dimensions, orientations, locations, and shapes will be determined in part by the particular intended application and use environment.

In the figures, reference numbers refer to the same or equivalent parts of the present invention throughout the several figures of the drawing.

DETAILED DESCRIPTION

Reference will now be made in detail to various embodiments of the present invention(s), examples of which are illustrated in the accompanying drawings and described below. While the invention(s) will be described in conjunction with exemplary embodiments, it will be understood that the present description is not intended to limit the invention (s) to those exemplary embodiments. On the contrary, the invention(s) is/are intended to cover not only the exemplary embodiments, but also various alternatives, modifications, equivalents and other embodiments, which may be included within the spirit and scope of the invention as defined by the appended claims.

An exemplary embodiment of the present invention will hereinafter be described in detail with reference to the accompanying drawings.

FIG. 1 is a schematic diagram of an engine system having a coolant control valve related to the present invention.

Referring to FIG. 1, an engine system includes a coolant pump 150, a block 170, a head 110, a coolant control valve 160, an EGR cooler 100, a radiator 120, an oil cooler 130, and a heater core 140.

Coolant that is pumped by the coolant pump 150 is supplied to the coolant control valve 160 through the block 170 and the head 110, the coolant is continuously supplied to the oil cooler 130 and the heater core 140, and the coolant that is supplied to the radiator 120 and the EGR cooler is selectively blocked.

In an exemplary embodiment of the present invention, the coolant that is supplied to the oil cooler 130 and the heater core 140 is selectively blocked.

The coolant control valve 160 controls the coolant that is respectively supplied to the EGR cooler 100, the radiator 120, the oil cooler 130, and the heater core 140 such that temperature of overall coolant is effectively controlled.

Figure 2:
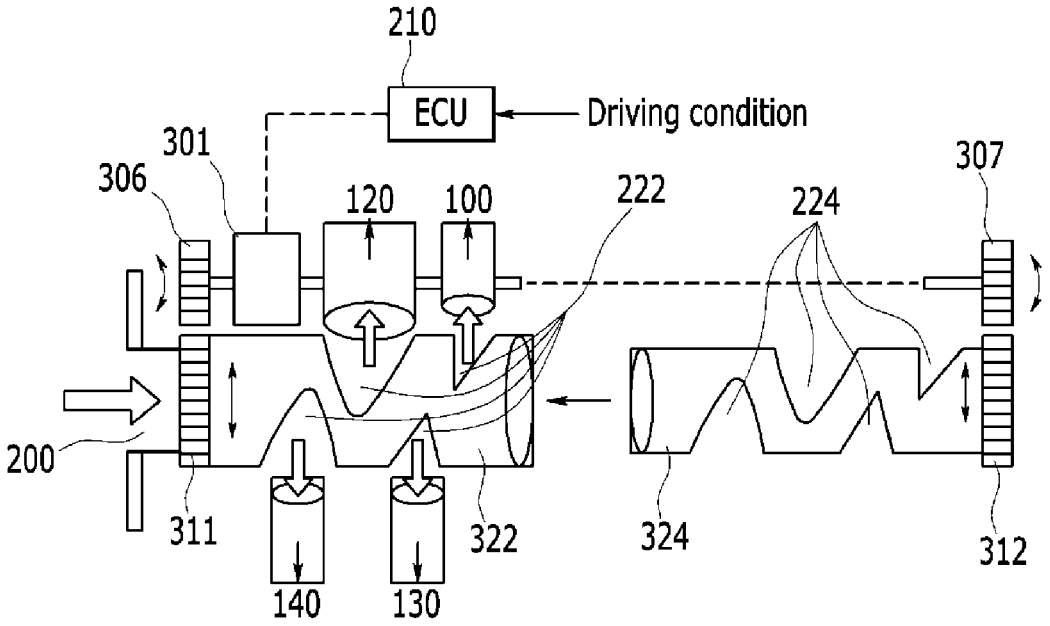
FIG. 2 is a schematic exploded view of a coolant control valve applied to an engine system according to an exemplary embodiment of the present invention.

FIG. 2 is a schematic exploded view of a coolant control valve applied to an engine system according to an exemplary embodiment of the present invention.

Referring to FIG. 2, a coolant control valve 160 includes a first cylindrical valve 322, a second cylindrical valve 324, a motor 301, a first drive gear 306, a first driven gear 311, a second drive gear 307, a second driven gear 312, and a control portion 210.

The first cylindrical valve 322 and the second cylindrical valve 324 have a cylindrical pipe structure, wherein the second cylindrical valve 324 is inserted into the first cylindrical valve 322. One end central portion of the first cylindrical valve 322 is connected to an inlet 200 that coolant flows in, and the inlet 200 is connected to an coolant outlet of the head.

A first outlet 222 and a second outlet 224 are formed on the first cylindrical valve 322 and the second cylindrical valve 324 from the interior toward the exterior, and the first outlet 222 and the second outlet 224 can be selectively connected to the radiator 120, the EGR cooler 100, the heater core 140, and the oil cooler 130.

In an exemplary embodiment of the present invention, a first driven gear 311 is formed on an exterior circumference of one end portion of the first cylindrical valve 322, the first driven gear 311 is engaged with the first drive gear 306, and the first drive gear 306 is disposed to be rotated by the motor 301.

Further, a second driven gear 312 is formed on an exterior circumference of the other end portion of the second cylindrical valve, the second driven gear 312 is engaged with the second drive gear 307, and the second drive gear 307 is disposed to be rotated by the motor 301.

The control portion 210 controls the motor 301 depending on a driving condition of an engine and coolant temperature to respectively control the rotation angle (position) of the first cylindrical valve 322 and the second cylindrical valve 324.

The first outlet 222 of the first cylindrical valve 322 and the second outlet 224 of the second cylindrical valve 324 rotate depending on the rotation position of the first cylindrical valve 322 and the second cylindrical valve 324, an area that the first outlet 222 is overlap with the second outlet 224 is controlled depending on the rotation position of them, and therefore the coolant flowing rate that is respectively supplied to the radiator 120, the EGR cooler 100, the heater core 140, and the oil cooler 130 can be controlled.

In an exemplary embodiment of the present invention, the motor 301 is operated to rotate the first drive gear 306 and the second drive gear 307, wherein a gear ratio between the first drive gear 306 and the first driven gear 311 is different from that between the second drive gear 307 and the second driven gear 312 such that a rotation speed of the first cylindrical valve 322 and the second cylindrical valve 324 can be different.

Further, if an area the first outlet 222 of the first cylindrical valve 322 and the second outlet 224 of the second cylindrical valve 324 are overlapped with each other is wide, the coolant flowing rate is high, and if the area that the first outlet 222 and the second outlet 224 are overlapped with each other is narrow, the coolant flowing rate is small.

Accordingly, in an exemplary embodiment of the present invention, the area that the first outlet 222 is overlapped with the second outlet 224 is accurately controlled such that the coolant flowing rate that is supplied to the radiator 120, the EGR cooler 100, the heater core 140, and the oil cooler 130 is accurately controlled.

Figure 3:
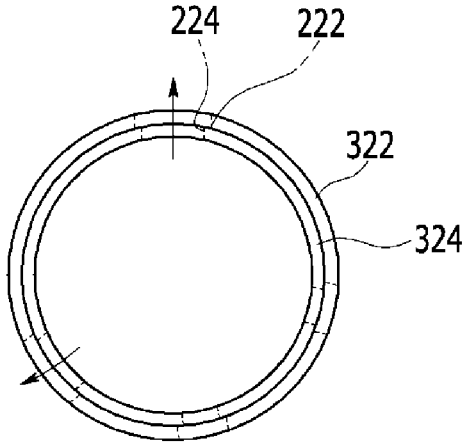
FIG. 3 is a partial cross-sectional view according to an exemplary embodiment of the present invention a coolant control valve applied to an engine system.

FIG. 3 is a partial cross-sectional view according to an exemplary embodiment of the present invention a coolant control valve applied to an engine system.

Referring to FIG. 3, an exterior circumference of the second cylindrical valve 324 contacts an interior circumference of the first cylindrical valve 322 to slides with each other.

And, the first outlet 222 of the first cylindrical valve 322 are arranged in a length direction of the first cylindrical valve 322 with a predetermined distance in a rotating direction, and the second outlet 224 of the second cylindrical valve 324 are arranged in a length direction of the second cylindrical valve 324 with a predetermined distance in a rotating direction.

Four first outlets 222 (a, b, c, d) are disposed, wherein "a" corresponds to the radiator 120, "b" corresponds to the EGR cooler 100, "c" corresponds to the heater core 140, and "d" corresponds to the oil cooler 130. And, four second outlets 224 (a, b, c, d) are disposed, wherein "a" corresponds to the radiator 120, "b" corresponds to the EGR cooler 100, "c" corresponds to the heater core 140, and "d" corresponds to the oil cooler 130.

Figure 4:
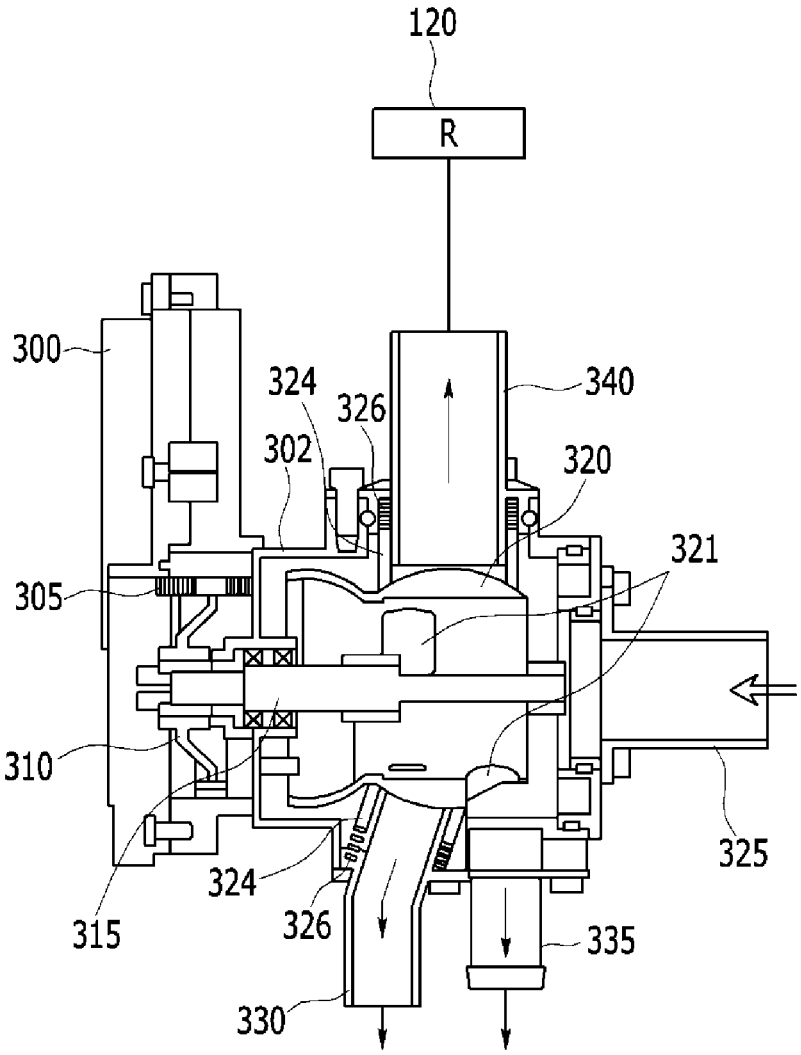
FIG. 4 is a cross-sectional view of a coolant control valve related to the present invention.

FIG. 4 is a cross-sectional view of a coolant control valve related to the present invention.

Referring to FIG. 4, a coolant control valve 160 includes a motor housing 300, an output gear 305, a driven gear 310, a rotation shaft 315, a valve housing 302, a cylindrical valve 320, a sealing member 324, and an elastic member 326, wherein a coolant inlet 325, a third supply line 340, a first supply line 330, and a second supply line 335 is respectively connected thereto.

The coolant that is supplied from the cylinder head 110 through the coolant inlet 325 flows into a central hollow portion of the cylindrical valve 320. And, an outlet 321 is formed from a central hollow portion to an outside surface of the cylindrical valve 320. The third supply line 340, the first supply line 330, and the second supply line 335 are disposed to corresponding to the outlet 321 on the valve housing 302.

If the output gear 305 is rotated by the motor that is disposed in the motor housing 300, the driven gear 310 is rotated thereby, and if the rotation shaft 315 that is connected to the driven gear 310 is rotated, the cylindrical valve 320 is rotated thereby.

If the outlet 321 corresponds to at least one of the third supply line 340, the first supply line 330, or the second supply line 335 in accordance with the cylindrical valve 320, the coolant is supplied to at least one of the radiator 120, the heater core 140, or the oil cooler 130 through the outlet.

A sealing member 324 and an elastic member 326 are disposed between the supply lines and an exterior circumference of the cylindrical valve 320. The sealing member 324 has a short pipe shape, one end of the supply line is inserted into the member 324, a front end surface of the sealing member 324 contacts an exterior circumference of the cylindrical valve 320, the elastic member 326 elastically supports the sealing member 324 toward the cylindrical valve such that the sealing member 324 forms a sealing structure with the cylindrical valve 320.

Figure 5:
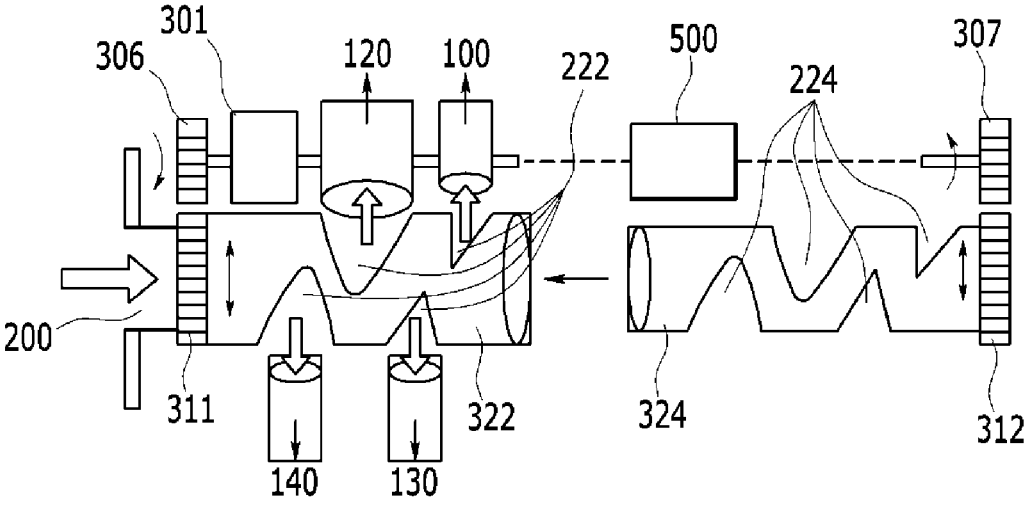
FIG. 5 is a schematic exploded view of a coolant control valve applied to an engine system according to an exemplary embodiment of the present invention.

FIG. 5 is a schematic exploded view of a coolant control valve applied to an engine system according to an exemplary embodiment of the present invention. In the FIG. 5, parts that are similar with the FIG. 2 will be omitted, and the different parts will be detailed.

Referring to FIG. 5, the first drive gear 306 and the second drive gear 307 are disposed to be rotated by the motor 301, the first drive gear 306 is direct connected to the first motor 301*a*, and the second drive gear 307 is connected to the motor 301 through a gear box 500.

The gear box 500 transforms a rotation speed or a rotating direction of the motor 301 to transmit this to the second drive gear 307. Accordingly, the rotation of the second cylindrical valve 324 can be actively controlled.

Figure 6:
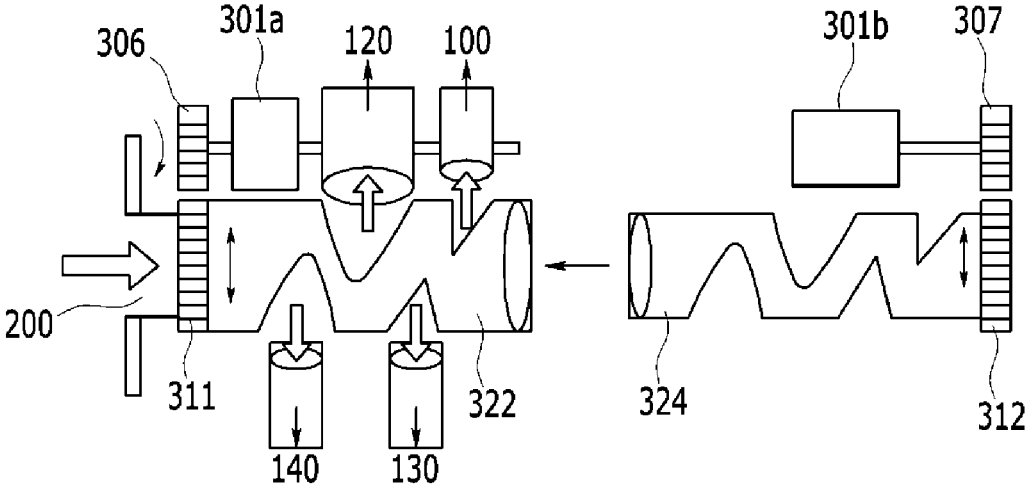
FIG. 6 is a schematic exploded view of a coolant control valve applied to an engine system according to another exemplary embodiment of the present invention.

FIG. 6 is a schematic exploded view of a coolant control valve applied to an engine system according to another exemplary embodiment of the present invention. A detailed description of the same or similar parts to FIG. 5 will be omitted and different parts will be described in FIG. 6.

Referring to FIG. 6, the first drive gear 306 is connected to a first motor 301*a*, the second drive gear 307 is connected to a second motor 301*b*, a control portion 210 respectively controls the first motor 301*a* and the second motor 301*b* to be able to actively control the rotation of the first cylindrical valve 322 and the second cylindrical valve 324.

For convenience in explanation and accurate definition in the appended claims, the terms "upper", "lower", "inner" and "outer" are used to describe features of the exemplary embodiments with reference to the positions of such features as displayed in the figures.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. They are not intended to be exhaustive or to limit the invention to the precise forms disclosed, and obviously many modifications and variations are possible in light of the above teachings as well as various alternatives and modifications thereof. It is intended that the scope of the invention be defined by the Claims appended hereto and their equivalents.

What is claimed is:

1. An engine system having a coolant control valve, comprising:

a first cylindrical valve in which a first outlet is formed from an interior surface to an exterior surface thereof, wherein the first cylindrical valve is rotatably disposed along a length direction central axis;

a second cylindrical valve that is inserted into the first cylindrical valve, an exterior circumference thereof sliding on the interior circumference of the first cylindrical valve, wherein a second outlet is formed on the second cylindrical valve corresponding to the first outlet of the first cylindrical valve, and the second cylindrical valve is separately rotatable in the first cylindrical valve;

a drive portion that is engaged to the first cylindrical valve and the second cylindrical valve and disposed to respectively rotate the first cylindrical valve and the second cylindrical valve; and a control portion that controls the drive portion depending on a driving condition such that an overlapped area of the first outlet and the second outlet is controlled and coolant flowing through the overlapped area is controlled.

2. The engine system having the coolant control valve of claim 1, wherein the drive portion includes:

a motor;

a first drive gear that is connected to the motor;

a first driven gear that is engaged to the first drive gear to rotate the first cylindrical valve;

a second drive gear that is connected to the motor; and a second driven gear that is engaged to the second drive gear to rotate the second cylindrical valve.

3. The engine system having the coolant control valve of claim 2, wherein the first drive gear and the second drive gear are directly connected to the motor.

4. The engine system having the coolant control valve of claim 2, wherein the first drive gear is directly connected to the motor and the second drive gear is connected to the second drive gear through a gear box that has a gear ratio or transforms a rotating direction.

5. The engine system having the coolant control valve of claim 2, wherein the motor includes a first motor corresponding to the first drive gear, and a second motor corresponding to the second drive gear.

6. The engine system having the coolant control valve of claim 2, wherein the first driven gear is formed on an exterior circumference of one end of the first cylindrical valve, and the second driven gear is formed on an exterior circumference of another end of the second cylindrical valve.

7. The engine system having the coolant control valve of claim 1, wherein the first outlet has a first output, a second output, a third output, and a fourth output, and the second outlet has a fifth output, a sixth output, a seventh output, and an eighth output, and the first and fifth outputs supply a radiator with coolant, the second and sixth outputs supply an EGR cooler with coolant, the third and seventh outputs supply a heater core with coolant, and the fourth and eighth outputs supply an oil cooler with coolant.

8. The engine system having the coolant control valve of claim 1, wherein coolant is supplied to a central hollow portion of the first cylindrical valve and the second cylindrical valve, and the coolant is supplied from a cylinder head of an engine.

* * * * *